United States Patent [19]

Harrowing

[11] 3,975,814

[45] Aug. 24, 1976

[54] RESTORATION OF SUCTION PRESS SHELLS

[76] Inventor: Sidney Stewart Harrowing, 949 Main St. East, Farnham, Quebec, J2N 2R6, Canada

[22] Filed: May 27, 1975

[21] Appl. No.: 581,228

[52] U.S. Cl. ..... 29/401 F; 29/423; 29/445; 156/253; 29/121.1

[51] Int. Cl.[2] ..... B22D 19/10; B23P 7/00

[58] Field of Search ..... 29/121 R, 401 F, 423, 29/445, 148.4 D; 156/253, 184, 187, 192

[56] References Cited

UNITED STATES PATENTS

| | | | |
|---|---|---|---|
| 1,988,640 | 1/1935 | Welsford | 156/192 X |
| 2,009,848 | 7/1935 | Keltie | 156/253 X |
| 2,115,543 | 4/1938 | Thackray | 156/184 X |
| 2,977,269 | 3/1961 | Nerwick | 156/184 UX |
| 3,063,888 | 11/1962 | Howard et al. | 156/187 |
| 3,205,112 | 9/1965 | Gilbert | 156/253 |
| 3,519,520 | 7/1970 | Newman | 156/184 X |
| 3,793,104 | 2/1974 | Harrowing | 156/253 X |

FOREIGN PATENTS OR APPLICATIONS

| | | | |
|---|---|---|---|
| 26,856 | 4/1971 | Japan | 156/253 |

*Primary Examiner*—Charlie T. Moon

[57] ABSTRACT

A process for restoring a suction press shell used in the removal of water in the formation of paper sheets, the shell consisting of a metal cylinder bonded with a rubber cover and perforated by multiple drainage holes which extend from the inner surface to the outer surface of the shell, the inner surface of the metal cylinder being worn and having lost its uniform aspect, the process comprises the steps of: cleaning and roughening the outer metal surface of the cylinder, winding under tension on the outer surface of the cylinder successive layers of a woven glass or synthetic fiber tape from 2 to 6 inches wide, and impregnating with a concentration of 35 to 55% of thermosetting resin until the required thickness of the tape for stiffening the cylinder within acceptable deflection limits is reached, each layer of tape overlapping the preceding layer by 25 to 90% at an angle of wrap of 5° to 15°, winding a reinforcing layer of a transparent cellulose film from 2 to 6 inches wide over the resin impregnated layers, heat treating the cylinder thus wrapped with the cellulose film at a temperature ranging from 212° to 300° F. for 2 to 8 hours to harden the layers of tape, grinding or tooling the outer surface of the cylinder thus heated to uniform surface and to remove the transparent cellulose film therefrom, applying a specially formulated rubber cover over the outer surface thus obtained after removal of the cellulose film, heat treating the rubber cover at 270° to 300°F. for 8 to 20 hours to promote vulcanization and adhesive reaction, redrilling the drainage holes of the cylinder thus completed to restore their normal extension from the inner surface of the metal cylinder to the outer surface of the newly bonded rubber cover, and boring the inside diameter of the metal shell to a uniform surface. The process also provides a good bonding of a rubber cover to the outer surface of the cylinder of the press shell. And, a press shell obtained by the above process.

24 Claims, 3 Drawing Figures

Fig. 1
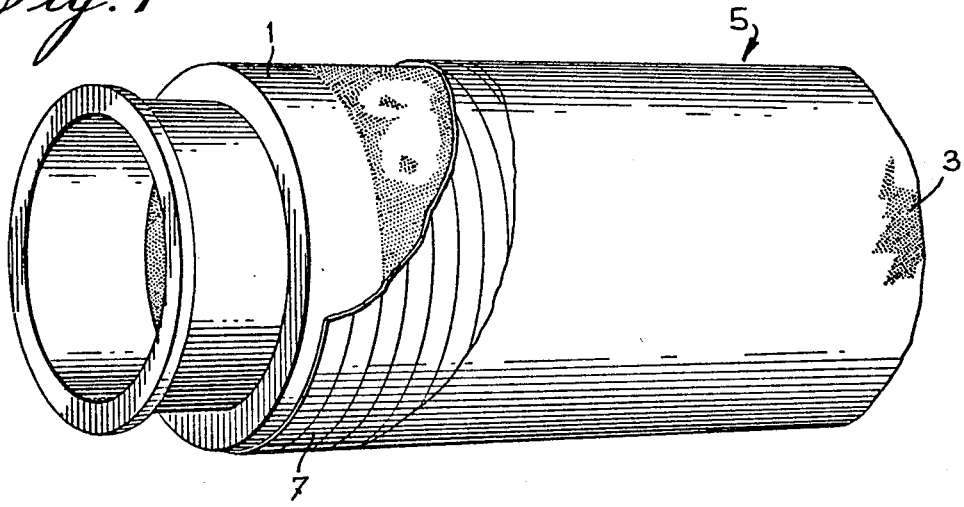
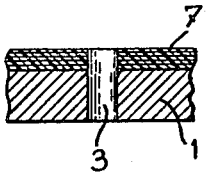
Fig. 3
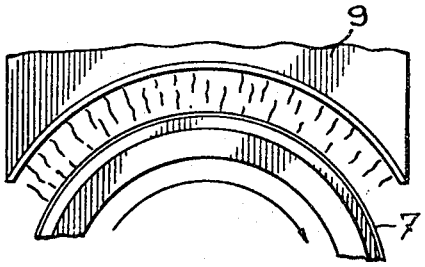
Fig. 2

RESTORATION OF SUCTION PRESS SHELLS

The present invention relates to a process for restoring old hollow suction press shells. The invention also relates to such restored suction press shells.

In a press section, the basic function is to remove water from the paper sheet passing between a rubber covered suction press shell and top press rolls. The sheet is supported on a woven felt which is further functional in water removal. The resulting contact area or nip, in large part causes removal of the water.

A further proportion of water is removed from the sheet by a suction box situated longitudinally on the inside surface of the hollow suction press shell. The box is sealed by means of sealing strips which press against the inner rotating surface of the shell. The strips, in turn are attached to the suction box. By means of a vacuum, the water which is being squeezed out in the nip is also drawn down through the perforations in the shell and vented from the suction box.

Maximum water removal by the suction press shell is obtained by means of a rubber cover, or sleeve bonded to the outer surface of the metal shell.

Over the life span of a metal press shell, the inner surface thereof becomes worn due to the abrasive action of grit and the suction box seals. This process continues until the inner surface of the press shell is so rough and worn that the press shell is rendered unserviceable. The removal of sufficient metal from the inner hollow press shell surface to permit continuing operation is possible but excessive metal removal can be sufficient to cause excessive deflection or bending across the face of the metal press shell beyond the point where it is serviceable.

Such a damaged press shell may be restored to working condition by the process of the present invention. In fact, the application of multiple layers of woven synthetic or glass fibres impregnated with thermosetting resins and heat treated to develop high modulus, tensile strength and hardness according to one of the objects of the present invention will stiffen the shell to within acceptable deflection limits. This will then permit removal of internal metal by boring the inside diameter to a uniform surface. At the same time, the process will permit, as latter stated, a chemically compatible rubber cover or sleeve to be bonded to the applied outer thermoset reinforced layer, a chemically compatible rubber compound specifically referring to diene containing polymers whose polymerization is dependent on diene.

As above noted the maximum water removal by the suction press shell is obtained by means of a rubber cover bonded to the outer surface of the metal shell. Therefore, in order to apply the woven synthetic or glass fibres on the outer metal surface of the cylinder of a press shell, the rubber cover already existing thereon should be removed and the outer metal surface thoroughly cleaned. Afterwards, a new rubber cover should be bonded to the cylinder and this bonding is carried out according to the process of the present invention.

A second object of the present invention resides therefore in the provision of bonding a rubber cover on the outer metal surface of the cylinder in order to provide a good bonding.

In the past, due to the rubber polymer and the chemistry of the rubber formulation, it has been impossible to establish compatibility between a rubber cover and the thermosetting resins which provide the bonding of the rubber cover on the outer metal surface of the shell. In fact, over the years, the use of bronze shells has been common and continues. A problem that has existed is that the copper present in the bronze reacts with the sulpher present in the rubber formulation, which, in turn, causes the formation of a copper sulphide film at the bond line. Considerable work has been done in the past years to develop a system which would eliminate the aforementioned copper sulphide. Unfortunately, the system has been found to have its weakness.

The process of the present invention, now permits compatibility to be established in such a way that high bond strength can now be obtained between the rubber and the thermosetting resins thus providing a good bonding of the rubber to the metal surface of the shell. Due to this condition, the rubber cover can be permitted to operate at high sheet speed and operating nip pressures thus restoring the press shell to its maximum water removal condition from the paper sheet.

The process according to the invention for restoring a suction press shell used in the removal of water in the formation of paper sheets, the shell consisting of a metal cylinder bonded with a rubber cover and perforated by multiple drainage holes which extend from the inner surface to the outer surface of the shell, the inner surface of the metal cylinder being worn and having lost its uniform aspect, comprises the steps of: cleaning and roughening the outer metal surface of the cylinder, winding under tension on the outer surface of the cylinder successive layers of a woven glass or synthetic fibre tape from 2 to 6 inches wide, after impregnating the tape with a concentration of 35 to 55% of thermosetting resin until the required thickness of the tape for stiffening the cylinder within acceptable deflection limits is reached, each layer of tape overlapping the preceding layer by 25 to 90% at an angle of wrap of 5° to 15°, winding a reinforcing layer of a transparent cellulose film from 2 to 6 inches wide over the resin impregnated layers, heat treating the cylinder thus wrapped with the cellulose film at a temperature ranging from 212° to 300°F. for 2 to 8 hours to harden the layers of tape, grinding or tooling the outer surface of the cylinder thus heated to uniform surface and to remove the transparent cellulose film therefrom, applying a specially formulated rubber cover over the outer surface thus obtained after removal of the cellulose film, heat treating the rubber cover at 270° to 300°F. for 8 to 20 hours to promote vulcanization and adhesive reaction, redrilling of the drainage holes of the cylinder thus completed to restore their normal extension from the inner surface of the metal cylinder to the outer surface of the newly bonded rubber cover, and boring the inside diameter of the metal shell to a uniform surface.

It is to be noted that all the above steps may be used, except the last step of boring the inside diameter of the metal shell when it is desired to only bond a rubber cover on the outer metal surface of the cylinder. The invention therefore may also apply to brand new suction press shells during the bonding of the rubber cover to their outer metal surface as well as to used press shell, from which the rubber cover originally bonded is loosened for the reasons above explained.

As above mentioned, if it is desired to only provide good bonding between the outer metal surface of the cylinder of a suction press shell and a rubber cover, all the above steps 1 to 8 are carried out in the same manner except the step 9 which is not carried out because it is not necessary in the concerned case. However, the step 9 can be carried out later if the inner surface of the metal cylinder thus bonded with a rubber cover is worn.

Therefore the process according to the invention for restoring a suction press shell used in the removal of water in the formation of paper sheets, the shell consisting of a metal cylinder bonded with a rubber cover and perforated by multiple drainage holes which extend from the inner surface to the outer surface of the shell, the rubber cover having lost its bond with the outer metal surface of the cylinder, comprises the steps of: cleaning and roughening the outer metal surface of the cylinder, winding under tension on the outer surface of the cylinder successive layers of a woven glass or synthetic fibre tape from 2 to 6 inches wide, after impregnating the tape with a concentration of 35 to 55% of thermosetting resin until the required thickness for stiffening the cylinder within acceptable deflection limits is reached, each layer of tape overlapping the preceding layer by 25 to 90% at an angle of wrap of 5° to 15°, winding a reinforcing layer of a transparent cellulose tape from 2 to 6 inches wide over the resin impregnated layers, heat treating the cylinder thus wrapped with the cellulose film at a temperature ranging from 212° to 300°F. for 2 to 8 hours to harden said layers of tape, grinding or tooling the outer surface of the cylinder thus heated to uniform surface and to remove the transparent cellulose film therefrom, applying a specially formulated rubber cover over the outer surface thus obtained after removal of the cellulose film, heat treating the rubber cover at 270° to 300°F. for 8 to 20 hours to promote vulcanization and adhesive reaction, redrilling the drainage holes of the cylinder thus completed to restore their normal extension from the inner surface of the metal cylinder to the outer surface of the newly bonded rubber cover.

Furthermore according to the present invention a suction press shell used in the removal of water in the formation of paper sheets includes a metal cylinder, successive layers of a woven glass or synthetic fibre tape fron 2 to 6 inches wide impregnated with a concentration of 35 to 55% of thermosetting resin and wound under tension on the outer metal surface of the cylinder to a thickness adequate for stiffening the cylinder within acceptable deflection limits, each layer of tape overlapping the preceding layer by 25 to 90% at an angle of wrap of 5° to 15°. A specially formulated rubber cover is bonded to the outer metal surface of the cylinder by means of the layers of thermosetting resin impregnated woven glass or synthetic fiber tape. The press shell is perforated with drainage holes extending from the inner surface of the cylinder to the outer surface of the rubber cover.

In all of the above aspects of the present invention, the concentration of the thermosetting resin may preferably be 35 to 40%, the tape overlapping be 35 to 50% and the angle of wrap be 10° to 15°.

The invention will now be described with reference to a preferred embodiment thereof having reference to the accompanying drawings in which:

FIG. 1 illustrates a perspective view of a suction press shell restored according to the process of the present invention;

FIG. 2 illustrates the heat treating of the cylinder after the step of winding or wrapping on the outer surface of the cylinder the layers of woven glass impregnated with a thermosetting resin and the layer of transparent cellulose film is carried out;

FIG. 3 illustrates a partial section of a press shell wherein the holes are redrilled after the restoration of the shell to its working condition.

Referring now to the figures, there is shown in FIG. 1 a restored suction press shell 1 having a plurality of drainage holes 3 therein (only a few shown) pierced through the shell and its reinforcement rubber covering designated generally by reference 5.

It is assumed that the original drainage holes are not badly affected and therefore their restoration is not in question in this application. Furthermore, for the below detailed example it is assumed that it is only the inner surface of the metal cylinder which is worn and has lost its uniform aspect. In order therefore to restore such a suction press shell into its working condition the following steps are performed:

1. The outer surface of the metal cylinder of the suction press shell 1 is cleaned in order to remove therefrom the old resin and the rubber cover and is roughened; such step may be carried out by blasting with either angular steel or aluminum oxide grit;

2. successive layers 7 of a woven glass or synthetic fiber tape of 4 inches wide are then wound spirally on the outer surface of the cylinder 1. The tape is first passed through a resin impregnating bath where a concentration of 40% resin is impregnated into the tape. Each layer of tape overlaps the preceding layer by 50% and the angle of wrap is 13°. Successive layers are built up until the required or specified thickness of the tape for stiffening the cylinder within acceptable deflection limits is reached. During the complete operation, the shell or the cylinder is kept rotating so as to permit the excess resin to flow into minor impressions on the outer surface of the cylinder, 3. winding a reinforcing layer of a transparent cellulose film of 4 inches wide over the resin impregnated layers, 4. placing an infrared heat tunnel 9 over the shell and applying a heat treatment of 300°F. for 2 to 8 hours (this length of time depends on the mass of metal of the shell and on the above mentioned materials applied thereon) to the resin impregnated layers of woven glass or synthetic fibre tapes and the cellulose tape, as illustrated in FIG. 2, to harden these layers, 5. grinding or tooling the outer surface of the shell thus heated to uniform diameter and to remove the transparent cellulose film therefrom. In fact, after the heat treatment, the transparent cellulose film is removed in order to expose the resin fabric surface. It is this surface to which the rubber formulation is applied and bonded in the next two steps.

6. applying a specially formulated rubber employing a peroxide vulcanization system over the outer surface thus obtained after removal of the cellulose film, 7. heat treating the specially formulated rubber at 280°F. for periods from 8 to 20 hours to promote vulcanization and adhesive reaction, (the time controlling factor here once again is the same as in paragraph 4 above mentioned)

8. redrilling the drainage holes to restore their extention from the inner surface of the shell to the outer surface of the newly bonded rubber cover;

9. boring the inside diameter of the metal shell to a uniform surface.

As above explained, if it is desired only to bond a rubber cover to the outer surface of the metal cylinder, all the steps 1 to 8 are carried out except step 9.

FIG. 3 illustrates a segment in cross section of a restored suction press shell wherein the above mentioned steps of the process are all completed.

The invention also concerns a suction press shell which includes the following elements: a metal cylinder 1 perforated by multiple drainage holes 3 and wrapped with successive layers of a woven glass or synthetic fibre tape of 4 inches wide impregnated with a concentration of 40% thermosetting resins to a thickness adequate for stiffening the metal cylinder within acceptable limits. Each layer of tape overlaps the preceding layer by 50% and at an angle of wrap of 13°. A specially formulated rubber employing a peroxide vulcanization system is bonded to the outer metal surface of the cylinder by means of the layers of thermosetting resin impregnated woven glass or synthetic fibre tape as above described. The drainage holes 3 extend from the inner surface of the shell to the outer surface of the rubber cover.

I claim:

1. A process for restoring a suction press shell used in the removal of water in the formation of paper sheets, said shell consisting of a metal cylinder bonded with a rubber cover and perforated by multiple drainage holes which extend from the inner surface to the outer surface of the shell, the inner surface of the metal cylinder being worn and having lost its uniform aspect, the process comprising the steps of:

cleaning and roughening the outer metal surface of the cylinder, winding under tension on the outer surface of the cylinder successive layers of a woven glass or synthetic fibre tape from 2 to 6 inches wide after impregnating the tape with a concentration of 35 to 55% of thermosetting resin until the required thickness of the tape for stiffening the cylinder within acceptable deflection limits is reached, each layer of tape overlapping the preceding layer by 25 to 90% at an angle of wrap of 5° to 15°, winding a reinforcing layer of a transparent cellulose film from 2 to 6 inches wide over the resin impregnated layers, heat treating the cylinder thus wrapped with the cellulose film at a temperature ranging from 212° to 300°F. for 2 to [hours to harden said layers of tape, grinding or tooling the outer surface of the cylinder thus heated to uniform surface and to remove the transparent cellulose film therefrom, applying a specially formulated rubber cover over the outer surface thus obtained after removal of the cellulose film, heat treating the rubber cover at 270° to 300°F. for 8 to 20 hours to promote vulcanization and adhesive reaction, redrilling the drainage holes of the cylinder thus completed to restore their normal extension from the inner surface of the metal cylinder to the outer surface of the newly bonded rubber cover, and boring the inside diameter of the metal shell to a uniform surface.

2. A process according to claim 1, wherein:

said woven glass or synthetic fibre tape is 4 inches wide, wherein the concentration of the thermosetting resin is 40%, and wherein each layer of said tape overlaps the preceding layer by 50% at an angle of wrap of 13°, the preceding layer by 50% at an angle of wrap of 13°, the transparent cellulose film is 4 inches wide, the temperature of the heat for treating the cylinder is 300°, the heat for treating the rubber cover to promote vulcanization and adhesive reaction is 280°.

3. A process according to claim 1, wherein said woven glass or synthetic fibre tape is 4 inches wide.

4. A process according to claim 1, wherein the concentration of the thermosetting resin is 35 to 40%.

5. A process according to claim 4, wherein, the concentration of the thermosetting resin is 40%.

6. A process according to claim 1, wherein each layer of said tape overlaps the preceding layer by 35 to 50% and the angle of wrap is 10° to 15°.

7. A process according to claim 6, wherein each layer of said tape overlaps the preceding layer by 50% and the angle of wrap is 13°.

8. A process according to claim 1, wherein the transparent cellulose film is 4 inches wide.

9. A process according to claim 1, wherein the temperature of the heat for treating the cylinder is 300°.

10. A process according to claim 1, wherein the heat for treating the rubber cover to promote vulcanization and adhesive reaction is 280°.

11. A process according to claim 1, wherein said specially formulated rubber cover consists of a rubber employing a peroxide vulcanization system.

12. A process according to claim 1, wherein the cleaning and roughening step is performed by blasting using either angular steel or aluminum oxide grit.

13. A process for restoring a suction press shell used in the removal of water in the formation of paper sheets, said shell consisting of a metal cylinder bonded with a rubber cover and perforated by multiple drainage holes which extend from the inner surface to the outer surface of the shell, the rubber cover having lost its bond with the outer metal surface of the cylinder, the process comprising the steps of:

cleaning and roughening the outer metal surface of the cylinder, winding under tension on the outer surface of the cylinder successive layers of a woven glass or synthetic fibre tape from 2 to 6 inches wide after impregnating the tape with a concentration of 35 to 55% of thermosetting resin until the required thickness for stiffening the cylinder within acceptable deflection limits is reached, each layer of tape overlapping the preceding layer by 25 to 90% at an angle of wrap of 5° to 15°, winding a reinforcing layer of a transparent cellulose tape from 2 to 6 inches wide over the resin impregnated layers, heat treating the cylinder thus wrapped with the cellulose film at a temperature ranging from 212° to 300°F. for 2 to 8 hours to harden said layers of tape, grinding or tooling the outer surface of the cylinder thus heated to uniform surface and to remove the transparent cellulose film therefrom, applying a specially formulated rubber cover over the outer surface thus obtained after removal of the cellulose film, heat treating the rubber cover at 270° to 300°F. for 8 to 20 hours to promote vulcanization and adhesive reaction, redrilling the drainage holes of the cylinder thus completed to restore their normal extension from the inner surface of the metal cylinder to the outer surface of the newly bonded rubber cover.

14. A process according to claim 13, wherein:

said woven glass or synthetic fibre tape is 4 inches wide, wherein the concentration of the thermosetting resin is 40% and wherein each layer of said tape overlaps the preceding layer by 50% at an angle of wrap of 13°, the transparent cellulose film is 4 inches wide, the temperature of the heat for treating the cylinder is 300°, the heat for treating the rubber cover to promote vulcanization and adhesive reaction is 280°.

15. A process according to claim 13 wherein said woven glass or synthetic fiber tape is 4 inches wide.

16. A process according to claim 13, wherein the concentration of the thermosetting resin is 35 to 40%.

17. A process according to claim 16 wherein, the concentration of the thermosetting resin is 40%.

18. A process according to claim 13, wherein each layer of said tape overlaps the preceding layer by 35 to 50% and the angle of wrap is 10° to 15°.

19. A process according to claim 18 wherein each layer of said tape overlaps the preceding layer by 50% and the angle of wrap is 13°.

20. A process according to claim 13, wherein the transparent cellulose film is 4 inches wide.

21. A process according to claim 13 wherein the temperature of the heat for treating the cylinder is 300°.

22. A process according to claim 13 wherein the heat for treating the rubber cover to promote vulcanization and adhesive reaction is 280°.

23. A process according to claim 13, wherein said specially formulated rubber cover consists of a rubber employing a peroxide vulcanization system.

24. A process according to claim 13 wherein the cleaning and roughening step is performed by blasting using either angular steel or aluminum oxide grit.

* * * * *